United States Patent [19]

Raura et al.

[11] Patent Number: 4,588,007

[45] Date of Patent: May 13, 1986

[54] METHOD FOR RETARDING THE DULLING OF WOOD-MACHINING BLADES

[75] Inventors: Pentti Raura; Johan J. Hotma, both of Valko, Finland

[73] Assignee: Rauma-Repola Oy, Valko, Finland

[21] Appl. No.: 538,915

[22] Filed: Oct. 4, 1983

[30] Foreign Application Priority Data

Feb. 25, 1983 [FI] Finland ..... 830629

[51] Int. Cl.[4] ..... B27C 1/00

[52] U.S. Cl. ..... 144/176; 83/16; 83/171; 144/162 R; 241/95; 241/292.1; 361/233

[58] Field of Search ..... 241/47, 48, 95, 135, 241/136, 146, 151, 275, 292.1, 92, 93; 144/162 R, 2 R, 176; 361/233; 83/16, 171

[56] References Cited

U.S. PATENT DOCUMENTS

| | | | |
|---|---|---|---|
| Re. 12,715 | 11/1907 | Dawkins | 361/233 |
| 855,389 | 5/1907 | Dawkins | 361/233 |
| 3,823,880 | 7/1974 | Urschel | 241/95 |
| 4,301,846 | 11/1981 | Berggren | 144/162 R |
| 4,453,437 | 6/1984 | Ask | 83/171 |

FOREIGN PATENT DOCUMENTS

| | | | |
|---|---|---|---|
| 2639123 | 8/1976 | Fed. Rep. of Germany | 144/163 |

*Primary Examiner*—W. D. Bray

[57] ABSTRACT

A method for limiting the dulling of wood-machining blades wherein the blades are insulated from the frame of a woodworking machine tool and a negative voltage is applied to the blades during operation. The blade ring of the chipper is insulated from the rotating rotor of the chipper so that between the blade ring and the rotor there is generated a differential voltage the rotor carrying a positive voltage and the blade ring a negative voltage. By virtue of the invention, the blades need not be replaced or sharpened as often as those of prior art chippers.

5 Claims, 1 Drawing Figure

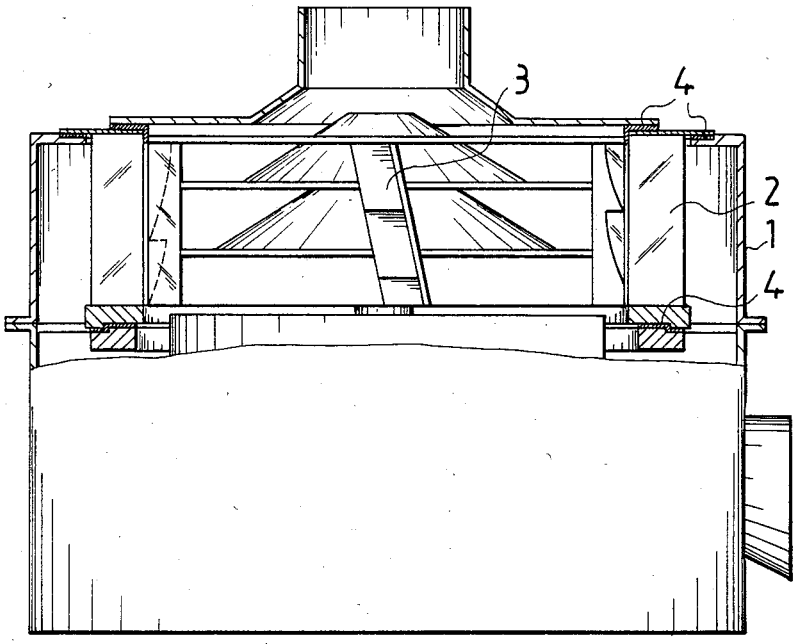
3
4
2
1
4

METHOD FOR RETARDING THE DULLING OF WOOD-MACHINING BLADES

The present invention concerns a procedure for limiting the dulling of wood-machining blades wherein the blade is insulated from the frame of the machine and a negative voltage is applied to the blade during operation.

A similar method has been disclosed e.g. in Finnish Pat. No. 27352 which has been used in conjunction with various wood-machining machines in which the blade cutting the wood moves and is easy to insulate from the rest of the machine's components. In chippers, the same problem is encountered as in other wood-machining machines, i.e., the blades are subject to wear and have to be replaced or sharpened at regular intervals. Since there is a plurality of blades on the blade ring, which is affixed to the frame of the machine, it has not been possible to generate on them any voltage difference with reference to the rest of the chipper's frame, rotor or other parts.

The method of the present invention is applied in a chipper so that the blade ring of the chipper is insulated from the chipper's rotating rotor and that between the blade ring and the rotor is produced a differential voltage so that on the rotor there is a positive voltage and on the blade ring a negative voltage. It is possible with the aid of the invention to simply insulate the entire blade ring from the frame and rotor, whereby the chips entering the chipper assume from the rotor a differential voltage with reference to the blades, whereby the dulling of the blades is limited, as has been presented in Finnish Pat. No. 27352.

An advantageous embodiment of the invention is that the blade ring is insulated from the chipper's frame and that a negative voltage is applied to the blade ring. Thus, all blades can be simply insulated from all other components of the chipper, whereby the negative voltage is with ease applied through the blade ring to all blades.

In another embodiment of the invention a voltage is applied to the blade ring which is about 1–2 kV with reference to the rotor and frame and to the chips. Tests have revealed that a differential voltage of this magnitude is sufficient to limit the dulling of the blades.

In a third embodiment of the invention between the blade ring and the frame are placed annular electrically insulating strips. The whole blade ring can thereby be insulated in a simple and advantageous manner, whereby it becomes easy to apply a voltage to it.

The invention is more fully described in the following description with the aid of an example with reference made to the attached drawing, presenting a chipper for use in the procedure, partly sectioned.

The chipper consists of a frame 1, a blade ring 2 affixed to the frame, and a rotor 3 rotating therewithin. The blade ring 2 has been insulated from the frame of the chipper by means of electrically insulating strips 4.

When during use of the chipper a negative voltage of 1–2 kV is applied to the blade ring with reference to the rotor and to the frame as well as the entering chips, the dulling of the blades will be limited quite considerably, compared with the dulling of the blades taking place in known chippers.

It is obvious to a person skilled in the art that the invention is not confined to the example presented in the foregoing description and that it may instead vary within the scope of the claims stated hereinbelow. For instance, it is not absolutely necessary to insulate the blade ring from the chipper frame; one may equally insulate the rotor and thereon produce a positive voltage, whereby the differential voltage will be the same as in the example presented above.

We claim:

1. In a method for retarding the dulling of wood-machining blades in a wood chipper having a blade ring connected to a frame and a rotatable rotor cooperating with said blade ring, the improvement comprising insulating said blade ring from said rotor and applying a differential voltage between said blade ring and said rotor during the chipping of wood by said blade ring and said rotor.

2. A method according to claim 1, wherein a positive voltage is applied to said rotor and a negative voltage is applied to said blade ring.

3. A method according to claim 2, wherein said blade ring is insulated from the frame of said chipper.

4. A method according to claim 1, wherein a voltage of from about 1–2 kV is applied to said blade ring with respect to said rotor, frame and wood chips.

5. A method according to claim 1, wherein said blade ring is insulated from said rotor by strips of annular, electrically insulating material.

* * * * *